United States Patent [19]

Lederman

[11] Patent Number: 4,695,104

[45] Date of Patent: Sep. 22, 1987

[54] COMPUTER FURNITURE

[76] Inventor: Elsie J. Lederman, 630 Victory Blvd., Apt. 6-G, Staten Island, N.Y. 10301

[21] Appl. No.: 818,375

[22] Filed: Jan. 13, 1986

[51] Int. Cl.[3] ..... A47B 81/00

[52] U.S. Cl. ..... 312/26; 312/24; 312/30; 312/208; 312/324

[58] Field of Search ..... 312/21, 22, 23, 24, 312/26, 30, 208, 239, 241, 324; 248/1 A, 1 B; 108/35, 39, 138

[56] References Cited

U.S. PATENT DOCUMENTS

| | | | |
|---|---|---|---|
| 427,841 | 5/1890 | Davis | 312/23 |
| 1,516,906 | 11/1924 | Axen | 312/24 |
| 1,713,594 | 5/1929 | Campbell | 312/23 X |
| 2,078,587 | 4/1937 | Sadenwater | 108/138 X |
| 2,258,782 | 10/1941 | McKean | 312/22 X |
| 2,316,756 | 4/1943 | Balster | 312/30 |
| 2,528,935 | 11/1950 | Williams | 312/30 X |
| 2,607,651 | 8/1952 | Preuss | 312/30 |
| 3,054,651 | 9/1962 | King et al. | 312/239 |
| 3,294,412 | 12/1966 | Good | 312/208 X |
| 3,823,993 | 7/1974 | Kakishima et al. | 312/30 X |

FOREIGN PATENT DOCUMENTS

| | | | |
|---|---|---|---|
| 569306 | 1/1959 | Canada | 312/24 |
| 1458821 | 11/1966 | France | 312/241 |
| 2480581 | 10/1981 | France | 312/26 |

*Primary Examiner*—Peter A. Aschenbrenner
*Assistant Examiner*—Thomas A. Rendos
*Attorney, Agent, or Firm*—Richard L. Miller

[57] ABSTRACT

A piece of computer furniture is provided and consists of foldable and hingable components which when closed is used as a flat top table and when open will present computer equipment in their proper positions to be used.

7 Claims, 9 Drawing Figures

COMPUTER FURNITURE

BACKGROUND OF THE INVENTION

The instant invention relates generally to desks and more specifically it relates to a piece of computer furniture.

Numerous desks have been provided in prior art that are adapted to support typewriters and the like in either a working position or a rest position. While these units may be suitable for the particular purpose to which they address, they would not be as suitable for the purposes of the present invention as heretofore described.

SUMMARY OF THE INVENTION

A principal object of the present invention is to provide a piece of computer furniture that will overcome the short comings of the prior art devices.

Another object is to provide a piece of computer furniture which when closed may be used as an ordinary flat top table and when open will present the computer equipment in the proper positions for use.

An additional object is to provide a piece of computer furniture that includes a flip up front portion for easy access to the keyboard, tape recorder and printer.

A further object is to provide a piece of computer furniture that is simple and easy to use.

A still further object is to provide a piece of computer furniture that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
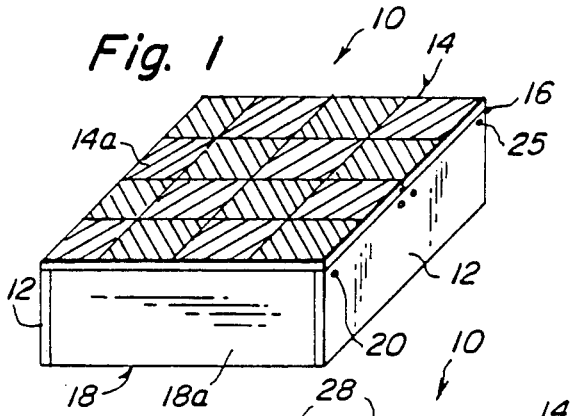
FIGS. 1 through 5 are perspective view of the invention showing the steps taken from stored to operating position.
Figure 2:
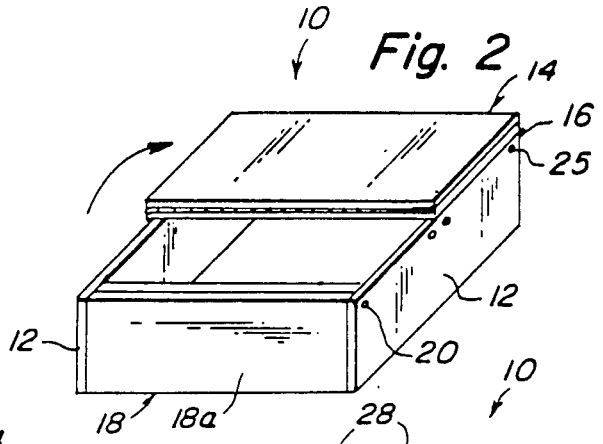
Figure 3:
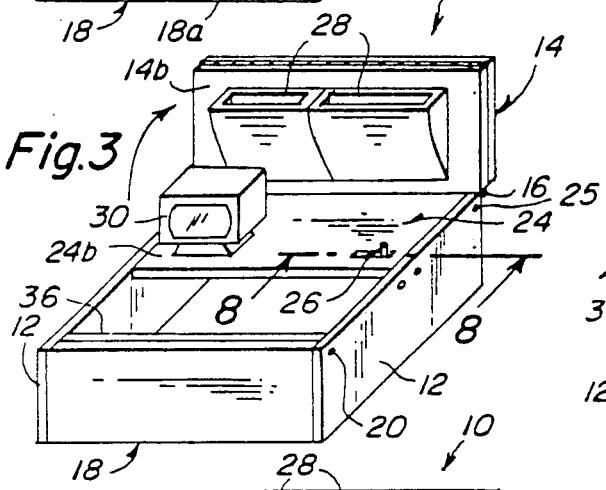
Figure 4:
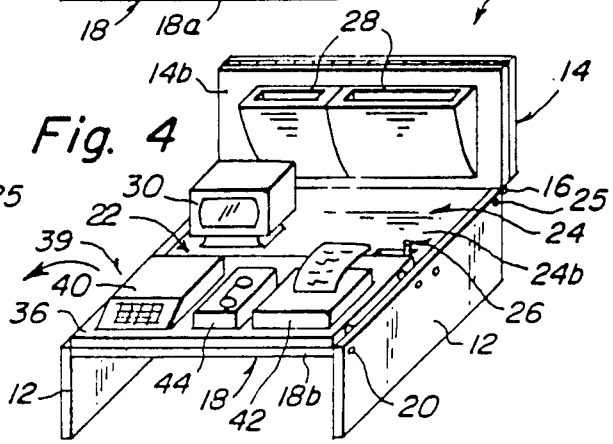
Figure 5:
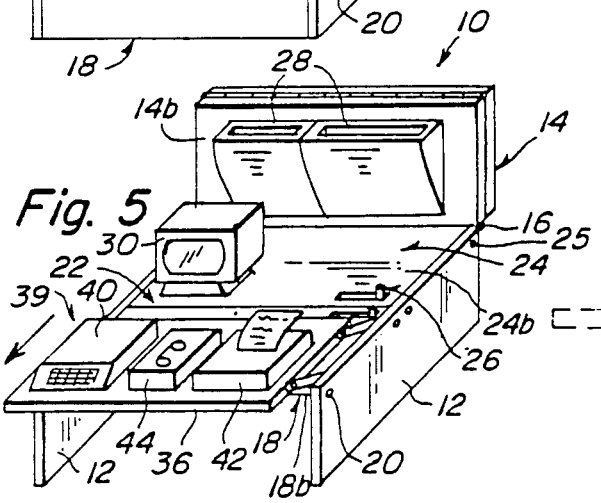

Turning now descriptively to the drawings in which similar reference characters denote similar elements throughout the several views, FIGS. 1 through 5 illustrate a piece of computer furniture 10. A pair of side panels 12 are spaced vertically apart. A foldable top 14 is hinged at 16 to rear of the side panels 12. The top 14 is arranged in one instance in a flat horizontal position for use as a table top 14*a* and in another instance in a foldable vertical position as a back support 14*b*.

A front panel 18 is hinged at 20 to the side panels 12. The front panel is arranged in one instance in a vertical position as a table front 18*a* and in another instance in a horizontal position as a front portion 18*b* of a computer desk top 22. A back panel 24 is hinged at 25 to the side panels 12. The back panel is arranged in one instance in a vertical position as a table back 24*a* and in another instance in a horizontal position as a back portion 24*b* of a computer desk top 22. Devices 26 are provided for locking the front panel 18 and the back panel 24 in the horizontal positions as the computer desk top 22.

Two receptacles 28 are secured to lower face of the foldable top 14. When the top is in the foldable vertical position as the back support 14*b* the receptacles 28 will be located in convenient positions for receiving computer data. A monitor 30 is secured to inner face of the back panel 24, when the back panel is in the horizontal position as the back portion 24*b* of the computer desk top 22 the monitor 30 will be located in a convenient position for viewing.

Figure 8:
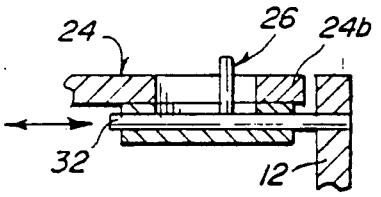
FIG. 8 is an enlarged cross sectional view taken along line 8—8 in FIG. 3 showing the locking mechanism therein.

The locking devices 26 include two slide bolts 32 (see FIG. 8). One of the slide bolts is secured to the front panel 18 near its side while other of the slide bolts 32 is secured to the back panel 24 near its side. When the front panel 18 and the back panel 24 are in their horizontal positions the slide bolts 32 each can be inserted within one of the side panels 12.

Figure 6:
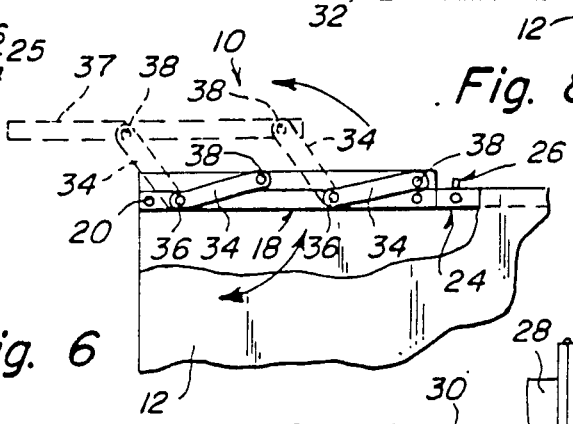
FIG. 6 is a partial side view with parts broken away showing the flip up front position.

As best seen in FIG. 6, the piece of computer furniture 10 further contains a plurality of arms 34 pivoted at 36 to side edges of the front panel 18. A flip up front portion 37 is pivoted at 38 at side edges to the arms 34. When the front panel 18 is in its horizontal position the flip up front portion 37 can flip up as shown in dotted lines. Equipment 39 such as keyboard 40, printer 42 and tape recorder 44 are secured to the flip up front portion 37. When the flip up front portion 37 is flipped up the equipment 39 will be at a height suitable for use.

Figure 7:
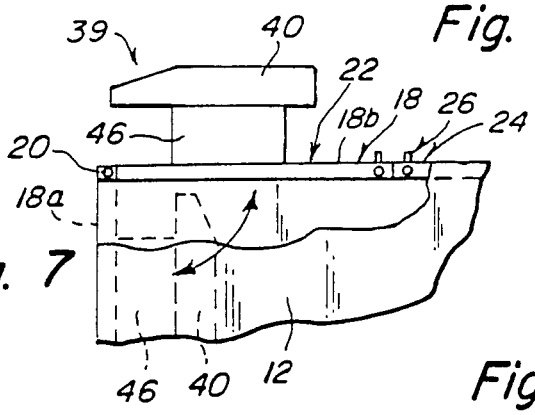
FIG. 7 is a partial side view with parts broken away showing a modified front position.
Figure 9:
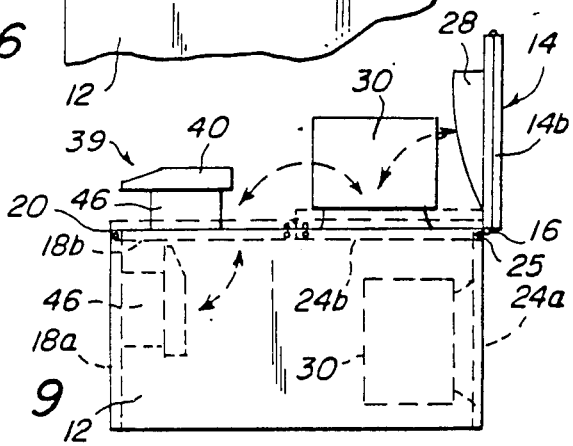
FIG. 9 is a side view showing the modified front position as indicated in FIG. 7 incorporated therein.

A modification is shown in FIGS. 7 and 9 whereby the equipment 39 such as keyboard 40, printer 42 and tape recorder 44 have pedestals 46 secured to inner face of the front panel 18. When the front panel is in the horizontal position as the front position 18*b* of the computer desk top 22 the equipment 39 will be at a height suitable for use.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A piece of computer furniture convertible between a rectangular table and a computer desk which comprises:

(a) a pair of side panels spaced horizontally apart;

(b) a foldable top extending entirely across said side panels and hinged to a rear edge of said side panels, said top arranged in one instance in a flat horizontal position for use as an entire table top of the rectangular table and in another instance in a foldable vertical position as a back support for the computer desk;

(c) a front panel extending entirely across each side panels and hinged to said side panels, said front panel arranged in one instance in a vertical position as an entire front of the table and in another instance in a horizontal position as a front part of the computer desk top;

(d) a back panel extending entirely across said side panels and hinged to said side panels, said back panel arranged is one instance in a vertical position as an entire back of the table and in another instance in a horizontal position as a back part of the computer desk top; and (e) means for locking said front panel and said back panel in said horizontal position to form together as the entire computer desk top.

2. A piece of computer furniture as recited in claim 1 further comprising at least one receptacle secured to a lower face of said foldable top so that when said top is in said foldable vertical position as said back support said at least one receptacle will be located in a convenient position for receiving computer data.

3. A piece of computer furniture as recited in claim 2 further comprising a monitor secured to an inner face of the back panel so that when said back panel is in said horizontal position as the back portion of said computer desk top, said monitor will be located in a convenient position for viewing.

4. A piece of computer furniture as recited in claim 3 wherein said locking means includes two slide bolts, one of said slide bolts is secured adjacent to a side of said front panel and other of said slide bolts is secured adjacent to a side of said back panel so that when said front panel and said back panel are in their horizontal positions said slide bolts each can be inserted within one of said side panels.

5. A piece of computer furniture as recited in claim 4 further comprising:

(a) a plurality of arms pivoted to side edges of said front panel; and (b) an adjustable front portion pivoted at side edges to said arms so that when said front panel is in its horizontal position said front portion can be lifted.

6. A piece of computer furniture as recited in claim 5 further comprising equipment such as a keyboard, printer and tape recorder secured to said front portion so that when said front portion is lifted up said equipment will be at a height suitable for use.

7. A piece of computer furniture as recited in claim 4 further comprising equipment such as a keyboard, printer and tape recorder having pedestals secured to an inner face of said front panel so then when said front panel is in said horizontal position as the front portion of the computer desk top said equipment will be at a height suitable for use.

* * * * *